US010501275B2

(12) United States Patent
Rasmussen et al.

(10) Patent No.: US 10,501,275 B2
(45) Date of Patent: Dec. 10, 2019

(54) BAIL ARM TO ROTATE AND OSCILLATE

(71) Applicant: Hewlett-Packard Development Company, L.P., Houston, TX (US)

(72) Inventors: Steve O Rasmussen, Vancouver, WA (US); Daniel Fredrickson, Portland, OR (US); Jason Young Carothers, Vancouver, WA (US); Kevin Lo, Vancouver, WA (US); Emma Frances Kelp-Stebbins, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/064,208

(22) PCT Filed: Apr. 15, 2016

(86) PCT No.: PCT/US2016/027816
§ 371 (c)(1),
(2) Date: Jun. 20, 2018

(87) PCT Pub. No.: WO2017/180152
PCT Pub. Date: Oct. 19, 2017

(65) Prior Publication Data

US 2018/0370748 A1 Dec. 27, 2018

(51) Int. Cl.
*B65H 31/26* (2006.01)
*B65H 31/02* (2006.01)

(52) U.S. Cl.
CPC ..... *B65H 31/26* (2013.01); *B65H 31/02* (2013.01); *B65H 2301/4212* (2013.01); *B65H 2402/31* (2013.01); *B65H 2404/63* (2013.01); *B65H 2801/06* (2013.01); *B65H 2801/15* (2013.01)

(58) Field of Classification Search
CPC ..... B65H 31/26; B65H 2301/4223; B65H 2402/31; B65H 2404/63
USPC ..... 271/220
See application file for complete search history.

(56) References Cited

U.S. PATENT DOCUMENTS

| | | | | |
|---|---|---|---|---|
| 4,211,499 | A | 7/1980 | Hunt et al. | |
| 4,265,444 | A | 5/1981 | Berglund | |
| 4,913,575 | A | 4/1990 | Wada | |
| 5,033,731 | A | 7/1991 | Looney | |
| 5,120,146 | A | 6/1992 | Nakayasu et al. | |
| 6,126,164 | A | 10/2000 | Rennick et al. | |
| 6,550,763 | B2 | 4/2003 | Gordon et al. | |
| 8,200,145 | B2 | 6/2012 | Kondo | |
| 2002/0175460 | A1 | 11/2002 | Wade | |
| 2010/0096801 | A1 | 4/2010 | Yanagida | |
| 2011/0006472 | A1* | 1/2011 | Hirai | B65H 31/02 271/220 |
| 2014/0291921 | A1 | 10/2014 | Kobayashi et al. | |

FOREIGN PATENT DOCUMENTS

JP 06127791 A * 5/1994

* cited by examiner

*Primary Examiner* — David H Bollinger
(74) *Attorney, Agent, or Firm* — HP Inc. Patent Department

(57) ABSTRACT

Examples disclosed herein relate to a device including a bail arm to rotate and oscillate. Examples include a shaft coupled above an output tray; and a bail arm to rotate and oscillate about a central axis of the shaft. In examples, the bail arm is to provide a downward force on the output tray.

13 Claims, 5 Drawing Sheets

BAIL ARM TO ROTATE AND OSCILLATE

BACKGROUND

Sheet outputting devices—including printers, finisher, copiers, scanners, fax machines, multifunction printers, all-in-one devices, or other devices—process and output media such as plain paper, photo paper, transparencies, and other media. In some examples, sheet outputting devices can output media stacks of metals and polymeric media, such as Compact Discs, in addition to or instead of broad and thin media. Sheet outputting devices may output multiple sheets of media into an output tray.

BRIEF DESCRIPTION OF THE DRAWINGS

The following detailed description references the drawings, wherein.

DETAILED DESCRIPTION

In the following discussion and in the claims, the term "couple" or "couples" is intended to include suitable indirect and/or direct connections. Thus, if a first component is described as being coupled to a second component, that coupling may, for example, be: (1) through a direct electrical or mechanical connection, (2) through an indirect electrical or mechanical connection via other devices and connections, (3) through an optical electrical connection, (4) through a wireless electrical connection, and/or (5) another suitable coupling. The term "approximately" as used herein to modify a value is intended to, be determined based on the understanding of one of ordinary skill in the art, and can, for example, mean plus, or minus up to 20% of that value.

A number of devices output sheets of media into an output bin or tray for retrieval. The speed at which electronic devices process media has been increasing. For example, printing speeds and scanning speeds of devices are increasing. As a result, media is being output to the output tray at increasing rates. Bail arms have been used to, control media from ejecting off the output tray. A number of different print jobs or scan jobs may be output by an electronic device to an output tray within a short period of time. However, user may not retrieve the output media immediately or may inadvertently retrieve unintended media from the output tray. As a result, bail arms are needed to control large volumes of media on an output tray while allowing a user to replace incorrectly retrieved jobs from the output tray. For example, a printer may have an output tray to accept hundreds of sheets of paper and a bail arm will need to control this stack of media from falling off the output tray while allowing a user to reinsert a few pages into the output stack.

To address these issues, in the examples described herein, a device is described which includes a bail arm to control output media. The bail arm is to rotate and oscillate about a shaft coupled to a device above an output tray of the device.

The bail arm may include two contact portions to apply a force to the output tray. The bail arm may include a curved surface to facilitate insertion of media onto the output tray from a direction perpendicular to a media output path.

Figure 1:
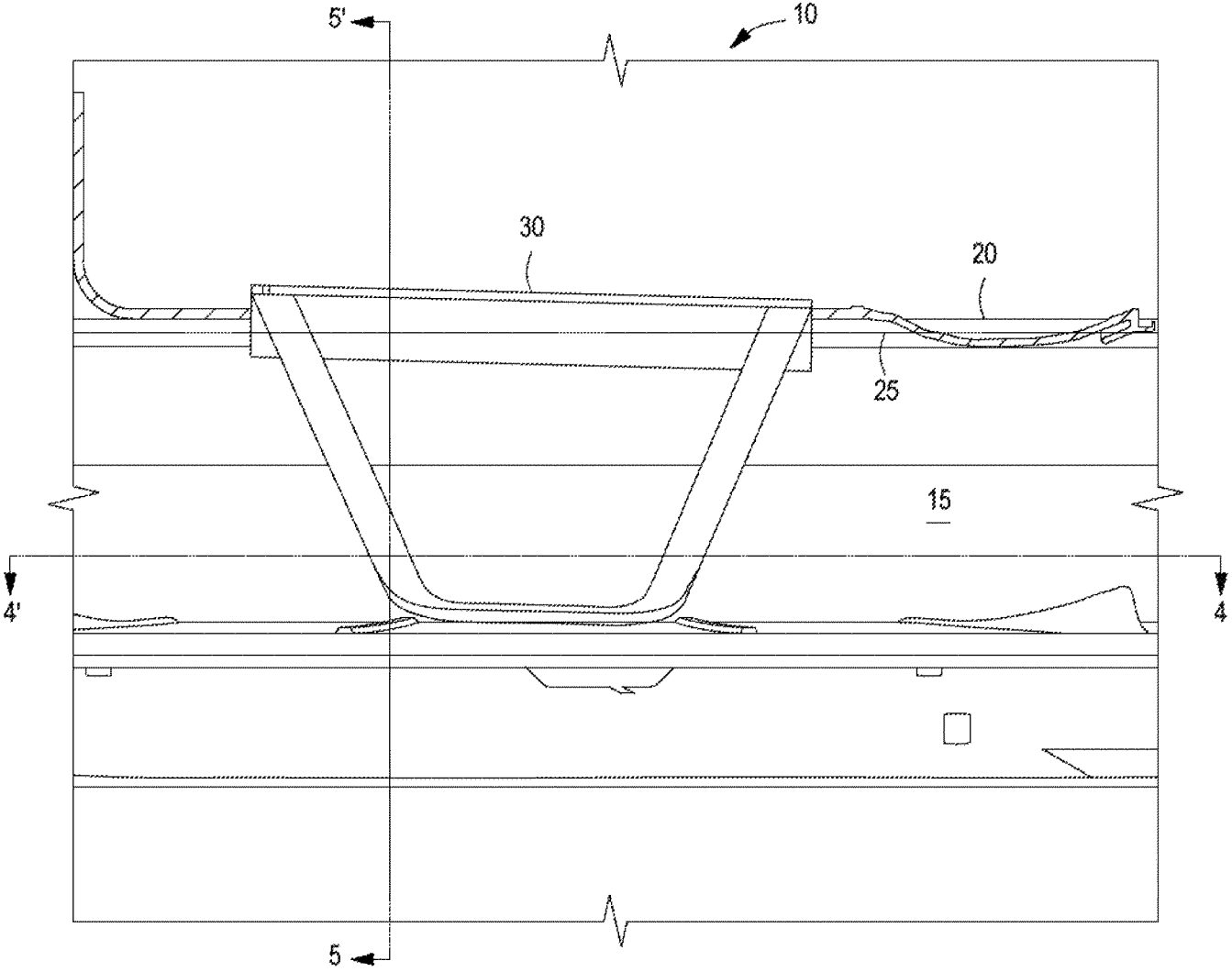
FIG. 1 is a partial schematic view of a device according to an example.
Figure 2:
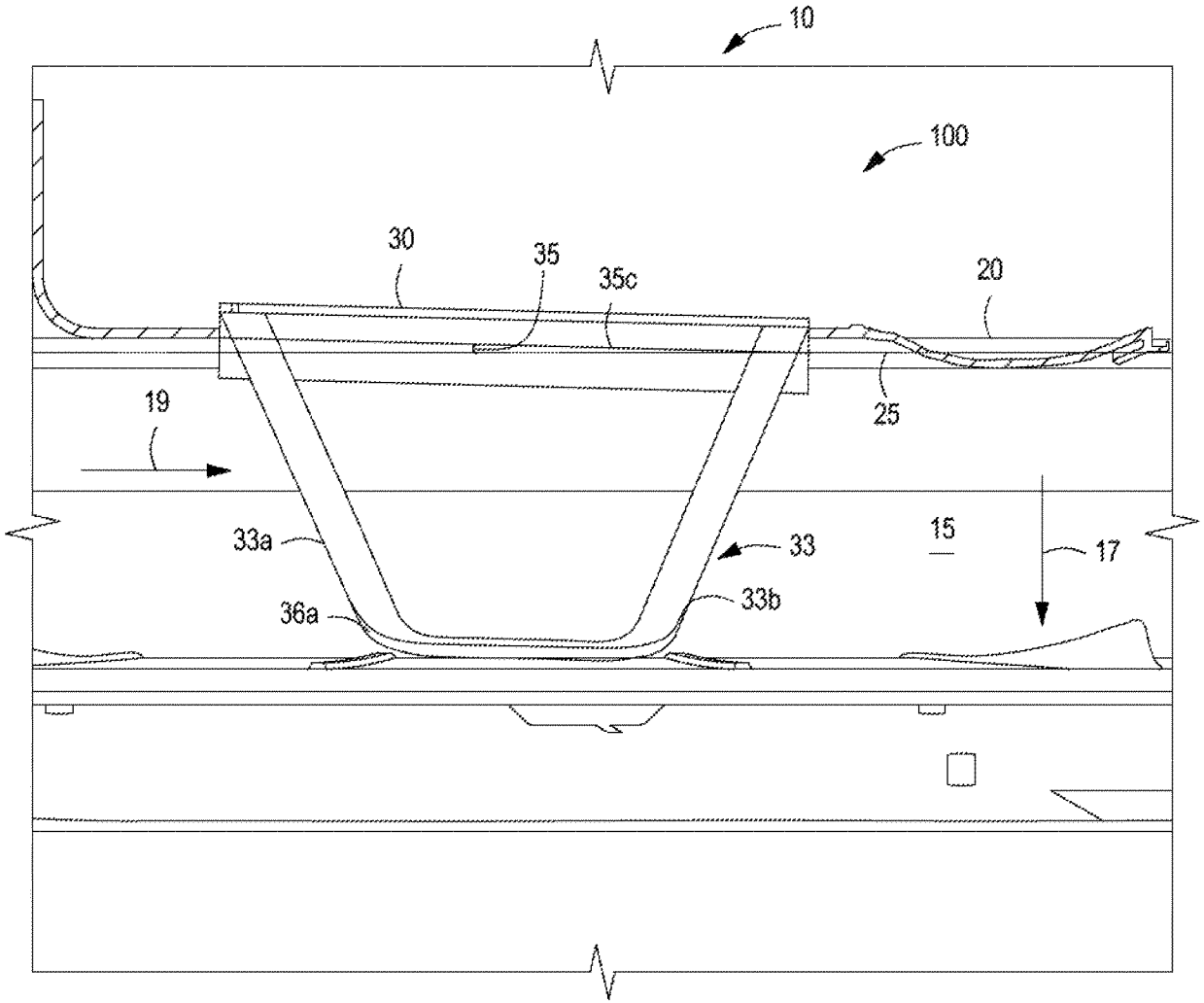
FIG. 2 is a partial schematic view of the device of FIG. 1 depicting an output tray assembly according to an example.
Figure 3:
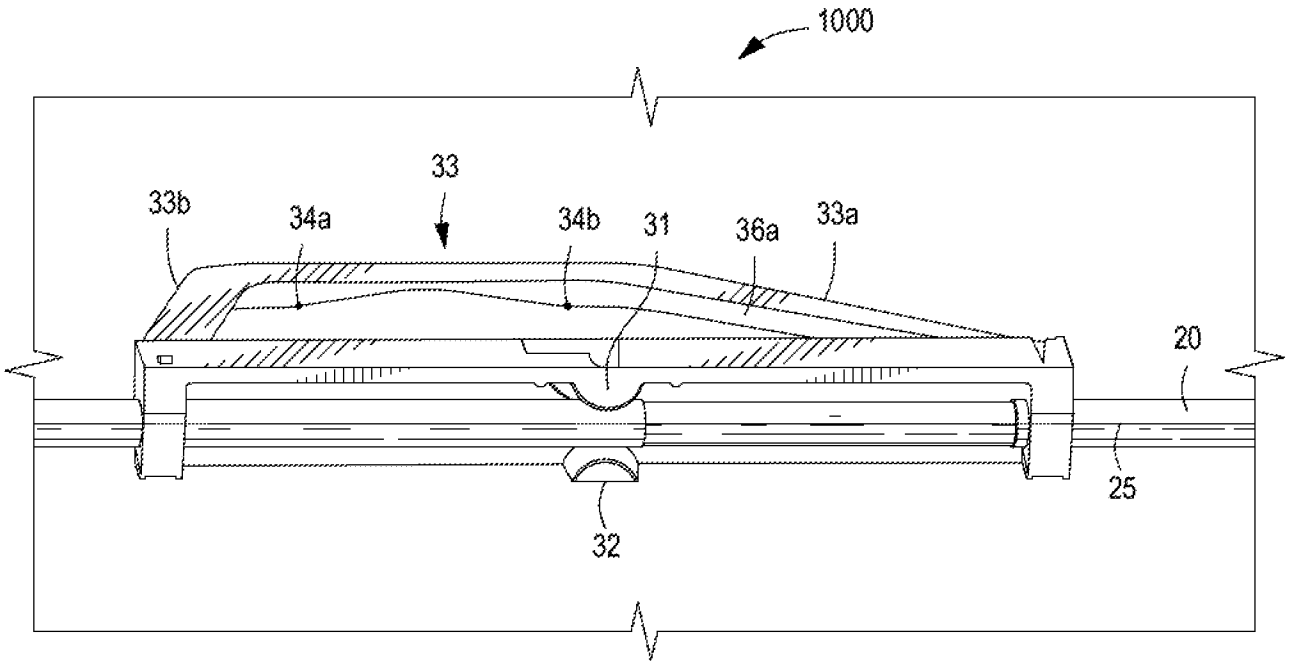
FIG. 3 is a partial rear schematic view of a bail arm, asset assembly according to an example.

Referring now to the drawings, FIG. 1 is a partial schematic view of a device 10 according to an example. FIG. 2 is a partial schematic view of device 10 of FIG. 1 depicting an output tray assembly 100 according to an example. FIG. 3 is a partial rear schematic view of a bail arm assembly 1000 according to an example. FIG, 4 is a schematic view of device 10 of FIG. 1 taken along line 4-4' according to an example. In examples, device 10 includes an output tray assembly 100. FIG, 5 is a schematic view of device 10 of FIG. 1 taken along line 5-5' according to an example. In examples, device 10 includes an output tray 15, a shaft 20, and bail arm 30. In examples, a bail assembly 1000 includes shaft 20 and bail arm 30. In, examples, shaft 20 is coupled to device 10 above output tray 15 and includes a central axis 25 about which bail arm 30 rotates and oscillates. In examples, bail arm 30 provides a downward force on output tray 15.

In examples, device 10 may be any device to output media which may be stacked on an output tray, such as an imaging device, a finisher, etc. An "imaging device" may be a hardware device, such as a printer, multifunction printer (MFP), or any other device with functionalities to physically produce graphical representation(s) (e.g., text, images, models etc.) on paper, photopolymers, thermopolymers, plastics, fabric, composite, metal, wood, or the like. In some examples, an MFP may be capable of performing a combination of multiple different functionalities such as, for example, printing, photocopying, scanning, faxing, etc. In examples, media may be any type of paper, photopolymers, thermopolymers, plastics, fabric, composite, metal, wood, etc., which may be stacked in an output tray 15 of device 10. In examples, device 10 may output media along media path 17. In examples, media path 17 may be an output media path or a media ejection path for media ejected by device 10. In an example, device 10 may be an inkjet printer to eject paper along media path 17 onto output tray 15. In other examples, device 10 may a laser printer to output media onto output tray 15.

In examples, output tray 15 may be any structure to receive media output from device 10. In some examples, output tray 15 may be integrated into device 10. In other examples, output tray 15 may be a separate device coupled to device 10. In examples, output tray 15 may include a surface to receive multiple sheets or a stack of output media from device 10. Various parameters related to output tray 15 may be selected for the particular use and design of device 10. For example, the dimensions and orientation of output tray 15 may be determined by the size of the device 10 and the particular use of the system.

In examples, shaft 20 may be coupled to device 10 above the receiving surface of output tray 15. Shaft 20 includes a central axis 25. Shaft 20 may be any type of shaft about which an object may rotate. In some examples, shaft 20 may be composed of any material to allow shaft 20 to securely engage and retain bail arm 30 on device 10 such as metal, plastic, composite, wood, etc.

In some examples, bail arm 30 may be any component with a surface area to apply a downward force on output tray 15. In examples, bail arm 30 may be configured to engage or contact a medium as it travels along media path 17 onto output tray 15. In examples, bail arm 30 may be configured to apply a downward force to a medium in output tray 15. In some examples, bail arm 30 may apply sufficient force to a medium traveling along media path 17 to retain the medium in output tray 15. For examples, bail arm 30 may be configured to apply sufficient force to retain paper being ejected by an inkjet printer into an output tray that includes a number of printed pages stacked thereon. In examples, bail arm 30 may be composed of any material with sufficient structural integrity to apply the downward force on output tray 15. For example, bail arm 30 may be composed of a metal, such as aluminum, plastic, wood, composite, such as a carbon fiber, carbon reinforced plastics, glass-filled plastic, glass-filled nylon, glass-filled polycarbonate, glass filled acrylonitrile butadiene styrene (ABS), etc. Various parameters related to bail arm 30 may be selected for the particular use and design of device 10. For example, the dimensions and orientation of bail arm 30 may be determined by the size of the device 10, the size and orientation of media stacked on output tray 15, the ejection rate of media onto output tray 15, and the particular use of the system. In an example, the dimensions of bail arm 30 may be chosen to allow variability in the dimensions of output media. For example, bail arm 30 may be dimensioned to contact different sized media, such as, A3 media or A4 media.

In some examples, bail arm 30 may be coupled to shaft 20 in any manner to rotate about central axis 25. In such examples, bail arm 30 may freely rotate about central axis 25 until it comes in contact with another component, for example, output tray 15 disposed below shaft 20. In examples depicted in FIG. 3, bail arm 30 may include a first protrusion 31 disposed adjacent to shaft 20. In other examples, first protrusion 31 may be disposed on shaft 20. In an example, bail arm 30 may oscillate about first protrusion 31 in a direction perpendicular to the central axis 25. In some examples, bail arm 30 may include a second protrusion 32 disposed opposite the first protrusion 31 to limit the oscillation of the bail arm 30. In examples, bail arm 30 may oscillate on shaft 20 up to an angle 35 between a centerline 35*c* of bail arm 30 and central axis 25. In some examples, angle 35 may be a range of angles approximately up to 5 degrees. In other examples, angle 35 may be a range of angles approximately up to 3 degrees. For example, angle 35 may be approximately 1.5 degrees. Although first protrusion 31 is depicted as disposed on a center of a portion of bail arm 30 parallel to central axis 25, the examples are not limited thereto and first protrusion 31 may be disposed on another location of bail arm 30. Although angle 35 is depicted as between central axis 25 and a centerline 35*e* of bail arm 30 along one surface plane of bail arm 30 coupled to shaft 20, it will be understood that bail arm 35 may oscillate about shaft 20 in other planes.

In examples, bail arm 30 may include a tapered u-section 33 disposed to contact output tray 15. Tapered u-section 33 may include a first contact portion 34*a* and a second contact portion 34*b* to contact output tray 15. In examples, the dimensions of first contact portion 34*a* and a second contact portion 34*b* may be determined by various parameters including the type and size of media stacked on output tray 15. the speed at which media may be ejected from device 10, the amount of media that may be stacked of output tray 15, etc. In operation, bail arm 30 may rotate and oscillate about shaft 20 to allow at least one of first contact portion 34*a* and and contact portion 34*b* to contact media traveling along media path 17 to retain media in output tray 15.

Figure 4:
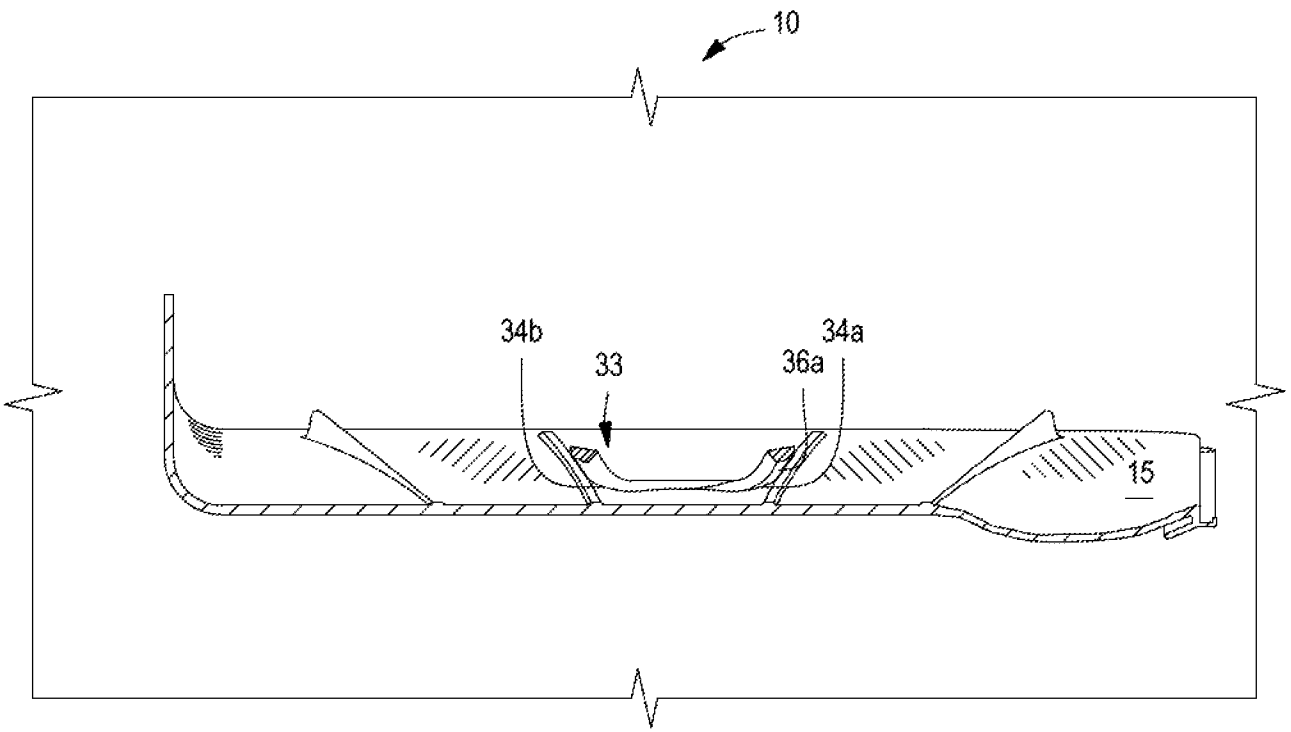
FIG. 4 is a schematic view of the device of FIG. 1 taken along line 4-4' according o an example.
Figure 5:
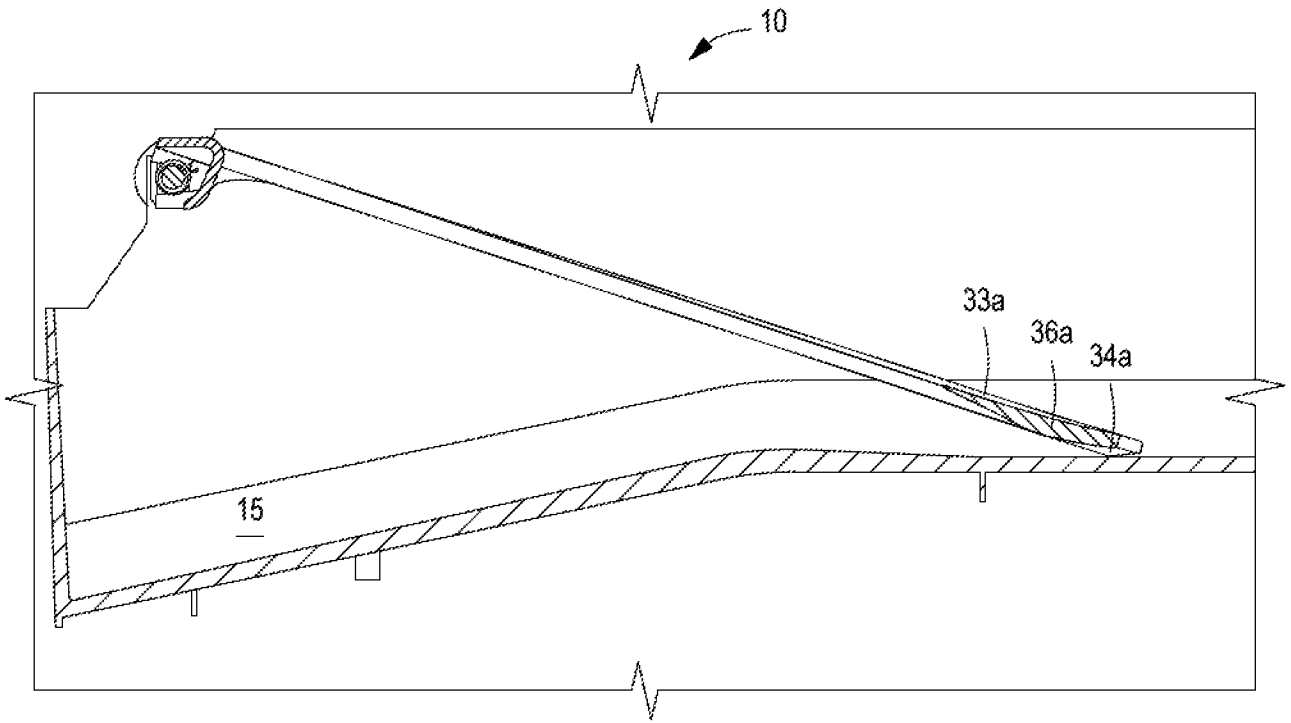
FIG. 5 is a schematic view of the device of FIG. 1 taken along line 5-5' according to an example.

In examples, bail arm 30 may, include a substantially curved or angled surface 36*a* along a portion of tapered u-section 33. In examples, surface 36*a* may be configured to allow for insertion of media onto output tray 15 from a direction along a media path 19. In examples, media path 19 may be substantially perpendicular to media path 17. As shown most clearly in FIGS. 4 and 5, surface 36*a* may curve upward away from first contact portion 34*a* to a first outer edge 33*a* of tapered u-section 33. In operation, in such an example, media inserted along media path 19 may be guided by surface 36*a* towards first contact potion 34*a*. In such an example, media inserted along media path 19 may apply a force to lift bail arm 30 such that the media may be inserted on to output tray 15. In such an example, a user may be able to insert media inadvertently removed from a media stack onto output tray 15 by inserting media along media path 19 and such inserted media may apply a force to move bail arm 30 upwards away from output tray 15. In such an example, in operation, bail arm 30 may move downwards toward output tray 15 after media is inserted along media path 19 to apply a force to the media via at least one of first contact portion 34*a* and second contact portion 34*b*. Various parameters of bail arm 30 may be selected for ease of insertion of media onto output tray 15 along media path 19. In some examples, a second substantially curved surface may extend from second contact portion 34*b* to an outer edge 33*b* of tapered u-section 33.

In examples, in operation, bail arm 30 may rotate and oscillate about shaft 20 such that first contact portion 34*a* and second contact portion 34*b* provide a downward force to a media stack ejected onto output tray 15. For example, device 10 may be an inkjet printer and first contact portion 34*a* and second contact portion 34*b* may be dimensioned and sized to provide sufficient downward force to retain ejected paper in output tray 15 without smearing ink deposited on the paper. In examples, bail arm 30's rotation and oscillation about shaft 20 may allow bail arm 30 to sit fiat on non-fiat, angled, and/or curled stacks of media. In examples, the issue of non-flat stacks may occur due to heavy ink images being ejected by an inkjet printer and not drying sufficiently before being ejected onto output tray 15. In examples, surface 36*a* may be curved in such a way as to provide guidance for the insertion of media along a media path 19 which may be substantially perpendicular to a media ejection path, media path 17. In an example, paper may be inserted onto output tray 15 using surface 36*a* as a guide to lift bail arm 30 for insertion.

While certain implementations have been shown and described above, various changes in form and details may be made. For example, some features that have been described in relation to one implementation and/ or process can be related to other implementations. In other words, processes, features, components, and/or properties described in relation to one implementation can be useful in other implementations. Furthermore, it should be understood that the systems, apparatuses, and methods described herein can include various combinations and/or sub-combinations of the components and/or features of the different implementations described. Thus, features described with reference to one or more implementations can be combined with other implementations described herein.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A device, comprising:

a shaft coupled above an output tray; and a bail arm to rotate and oscillate about a central axis of the shaft and to provide a downward force on the output tray, wherein the bail arm includes a first angled surface oriented to engage and guide insertion of media onto the output tray from a direction perpendicular to a media output path.

2. The device of claim 1, further comprising:

a first protrusion upon which the bail arm is to oscillate.

3. The device of claim 2, further comprising:

a second protrusion disposed opposite the first protrusion to limit the oscillation of the bail arm about the central axis to a limited angle of rotation.

4. The device of claim 3, wherein the limited angle of rotation is in a range up to 5 degrees.

5. The device of claim 3, wherein the limited angle of rotation is in a range up to 3 degrees.

6. The device of claim 1, wherein the bail arm includes a first contact portion and a second contact portion to apply the downward force on the output tray.

7. A bail arm assembly, comprising:

a shaft to couple to a device; and a bail arm coupled to the shaft to rotate and oscillate about a central axis of the shaft including:

a tapered U section to provide a downward force a first contact portion and a second contact portion; and an angled surface extending from the first contact portion oriented to engage and guide insertion of media onto an output tray from a direction perpendicular to a media output path.

8. The bail arm assembly of claim 7, wherein the bail arm further includes a first protrusion upon which the bail arm is to oscillate.

9. The bail arm assembly of claim 8, wherein the bail arm further includes a second protrusion disposed opposite the first protrusion to limit the oscillation of the bail arm about the central axis to a limited angle of rotation.

10. The bail arm assembly of claim 9, wherein the limited angle of rotation is in a range up to 5 degrees.

11. A output tray assembly comprising:

a surface to receive media;

a shaft coupled to the output tray above the surface; and a bail arm coupled to the shaft to rotate and oscillate about a central axis of shaft, wherein the bail arm includes a first angled surface oriented to engage and guide insertion of media onto the output tray from a direction perpendicular to a media output path.

12. The output tray assembly of claim 11, wherein the bail arm includes a first contact portion and a second contact portion to apply a force to the surface.

13. The output tray assembly of claim 11, further comprising a first protrusion and second protrusion disposed opposite the first protrusion to limit the oscillation of the bail arm about the central axis.

* * * * *